United States Patent [19]

Vandenbossche

[11] 4,213,498

[45] Jul. 22, 1980

[54] LOW-COST FLEXIBLE PLASTIC HEAT EXCHANGER

[75] Inventor: Benjamin E. Vandenbossche, Hillsborough, Calif.

[73] Assignee: American HCP, South San Francisco, Calif.

[21] Appl. No.: 960,829

[22] Filed: Nov. 15, 1978

[51] Int. Cl.[2] ..... F28D 1/06

[52] U.S. Cl. ..... 165/136; 165/46; 165/169

[58] Field of Search ..... 165/46, 135, 136, 168, 165/169, 170

[56] References Cited

U.S. PATENT DOCUMENTS

| | | | |
|---|---|---|---|
| 2,271,437 | 1/1942 | Lewis | 165/169 |
| 2,625,804 | 1/1953 | Patch et al. | 165/46 |
| 3,233,662 | 2/1966 | Yuen | 165/170 |
| 3,335,789 | 8/1967 | Raskin | 165/169 |
| 3,396,782 | 8/1968 | Valyi | 165/170 |
| 3,452,555 | 7/1969 | Thurman et al. | 165/46 |
| 3,538,719 | 11/1970 | Prader | 165/136 |
| 3,739,842 | 6/1973 | Waalon | 165/169 |
| 4,098,331 | 7/1978 | Ford et al. | 165/170 |
| 4,114,597 | 9/1978 | Erb | 165/170 |
| 4,150,720 | 4/1979 | Brackman | 165/170 |

FOREIGN PATENT DOCUMENTS

| | | | |
|---|---|---|---|
| 1286751 | 12/1962 | France | 165/46 |

*Primary Examiner*—Sheldon Richter

*Attorney, Agent, or Firm*—Joseph L. Strabala

[57] ABSTRACT

A modular plastic heat exchanger includes at least one thermal exchange element having parallel outer and inner plastic sheets separated by a plurality of parallel ribs extending between said sheets and connected thereto to form a plurality of channels generally rectangular in cross-section with a plastic insulating foam sized to be co-extensive with said outer sheet and secured to the exterior surface of said outer sheet, and a pair of cylindrical manifolds, each having a large central flow tube oriented normal to such channels in said thermal exchange element and fixedly secured to said thermal exchange element on opposite edges thereof, each of said manifolds being operably connected to fluidly communicate said channels to its flow tube at the ends of said channels, whereby the inner sheet can be tightly faced against a cylindrical member to be thermally controlled and temperature controlled fluids can be passed from one manifold to the other to control the temperature of the member.

4 Claims, 9 Drawing Figures

FIG_1
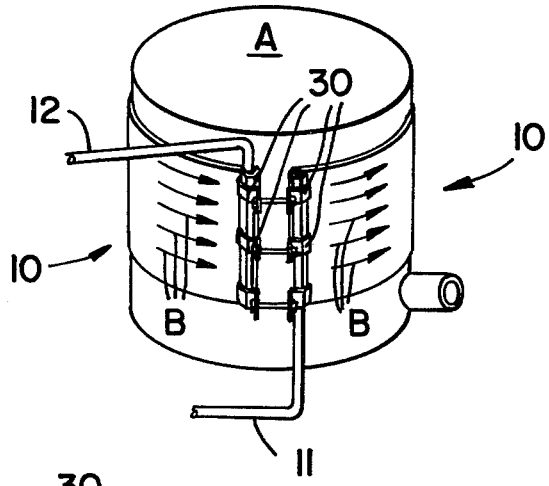
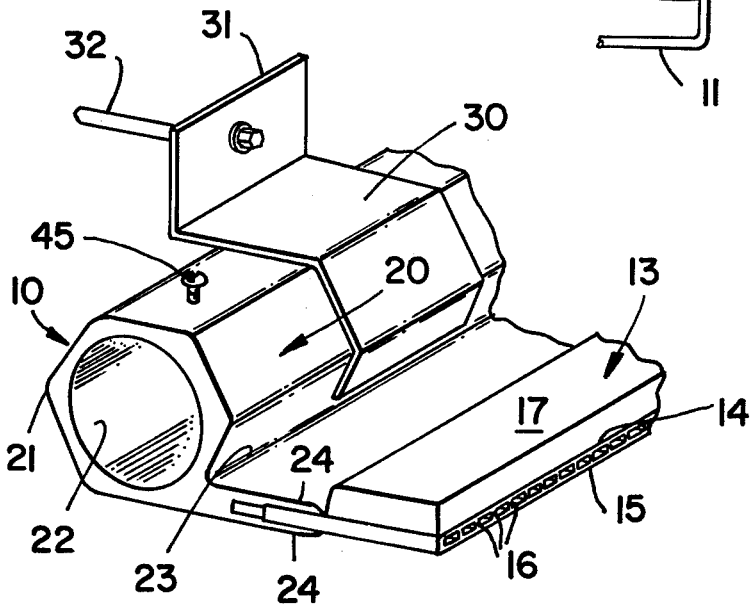
FIG_3
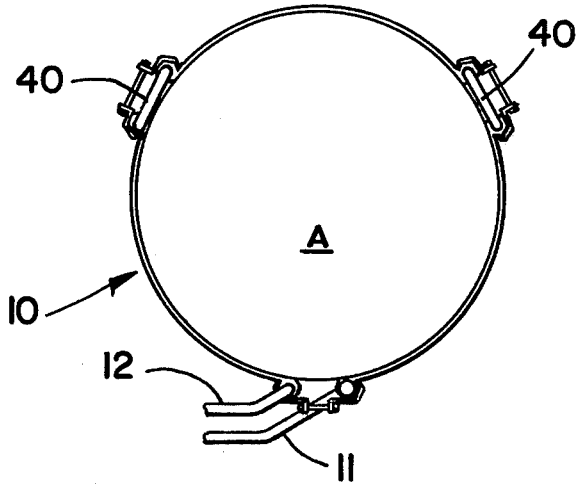
FIG_2

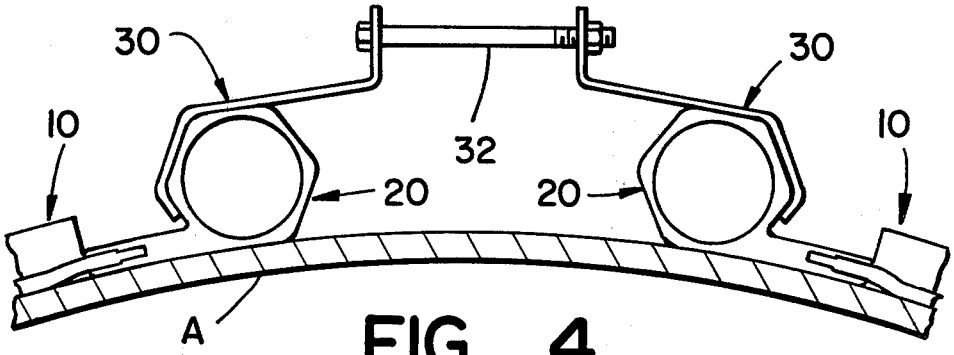
FIG_4
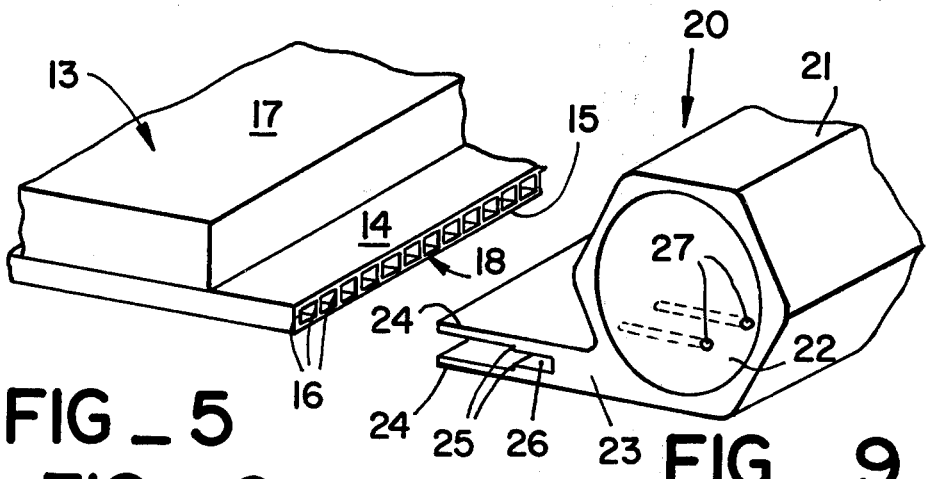
FIG_5
FIG_9
FIG_6
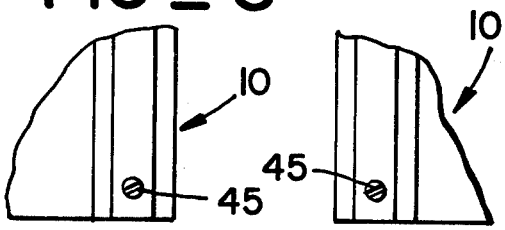
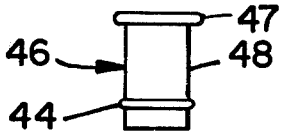
FIG_7
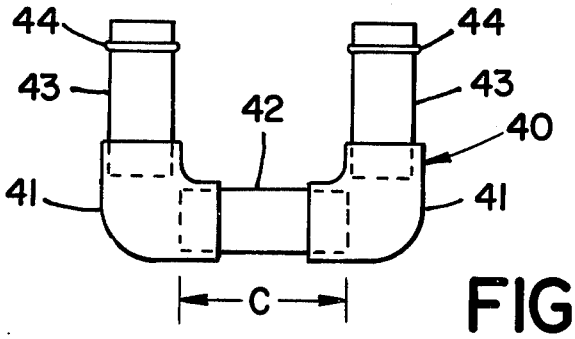
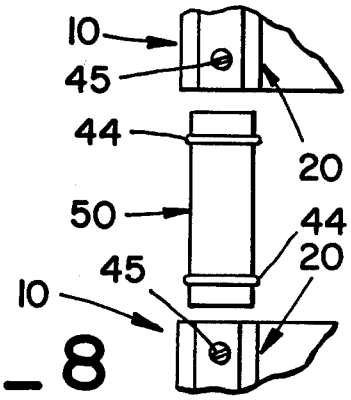
FIG_8

LOW-COST FLEXIBLE PLASTIC HEAT EXCHANGER

BACKGROUND OF THE INVENTION

While this invention relates generally to heat exchangers, it more specifically involves flexible heat exchangers that can be conformed to the outer cylindrical surface of tanks or the like. For example, wine vats are closely controlled in temperature, which is usually accomplished by circumferentially attaching a stainless steel jacket (heat exchanger) to the outer surface of the tank and pumping cooled fluids through the jacket. Since the stainless steel jacket is metal, a great deal of rime ice forms on its outer surface.

Although the stainless steel jackets work, their cost is substantial and the condensation of rime ice is a continuing problem. Also, they are difficult to install, and cannot be easily brought into integral contact with the surface of a cylindrical tank, even when custom made. In addition, these jackets usually have relatively high pressure drops across the inlet and outlet, resulting in high energy consumption in the pump transfer system circulating the heating or cooling fluid.

The good insulating characteristic of plastics is a drawback for their use in heat exchange elements. However, by using polyolefins, such as polypropylene and polyethylene, for the novel heat exchanger of this invention and designing it with large flat contacting surfaces, plus a high capacity flow rate of cooling or heating fluids on the opposite side of the thin plastic contacting surface, most of the prior problems of plastic heat exhangers have been minimized. The foam insulation adhered to the exterior surface eliminates the rime ice because it is sealed to the outer sheet forming the exchanger element so that no moisture-laden air can contact this surface. As a result, there is no condensation on this surface or on the exterior surface of the foam due to its insulating characteristics.

Economically, the heat exchangers according to this invention cost less than one-sixth of the prior art stainless steel jackets, and are much more easily conformed to the surface of a tank due to the flexibility of the plastic. Because it is constructed of plastic, the novel heat exchanger can be "stretched" slightly to fit properly when installed on a cylindrical surface, thereby ensuring positive contact with a tank or other cylindrical surface over the entire surface area where thermal heat exchange is to be accomplished.

Many factors determine the efficiency of heat exchangers, but with the innovations employed in this invention and the features achieved, this plastic exchanger rivals the prior art stainless steel jacket in efficiency. This is a totally unexpected result for a plastic exchanger.

Manifolds are specially designed for high flow rates and are securely connected to the thermal exchange portion so that a complete heat exchanger modular unit can be fitted to a surface by holding the manifolds with clamps or the like and stretching the unit slightly under tension across a cylindrical surface through adjusting bolts on the clamps. As the insulating foam is bonded only to an outer surface sheet of modular units, it is not placed under tension by this action. Further, the thickness of the thermal exchange is less than one-quarter inch (excluding the thickness of the foam insulation), which allows it to be conformed easily to cylindrical surfaces with diameters of over three feet without placing undue stress on its internal structures.

Polyolefins are non-corrosive, non-scaling and chemically inert, making this novel heat exchanger useful in corrosive and caustic environments. However, very strong oxidizing acids can cause slow oxidation, and organic solvents at temperatures of about 180° F. may cause some deterioration. Thus due to the construction and the characteristics of polyolefins, this novel heat exchanger has service temperatures from −40° F. to +300° F., and is useful with corrosive fluids of nearly all types.

SUMMARY OF THE INVENTION

The above advantages and economies can be recognized in a modular plastic heat exchanger having at least one thermal exchange means composed of parallel inner and outer plastic sheet means separated by a plurality of parallel flat ribs oriented normal to said sheet means and fused to said sheet means to form a plurality of parallel channels, an insulating foam layer co-extensive with the outer sheet means and sealingly adhered to its exterior surface, a first manifold means having a central large flow tube and a distributor means operably connected to said thermal exchange means at one edge so said flow tube is normal to the longitudinal axes of said channels and fluidly communicating said channels with said flow tube, a second manifold means having a large central flow tube and a distributor means operably connected to the opposite edge of said thermal exchange means to fluidly communicate said channels and its flow tube, whereby fluids can enter one flow tube and simultaneously pass through said thermal exchanger means to the other flow tube. The modular heat exchanger can include U-shaped fittings to interconnect said flow tubes so a number of modules can be placed in series to circumferentially extend around large tanks or the like.

DESCRIPTION OF THE DRAWINGS

This novel heat exchanger will be better understood by reference to the description thereof in conjunction with the following drawings, wherein:

FIG. 1 is a perspective of a tank (wine vat) with the novel plastic heat exchanger cinched to its outer circumference with clamps and arrows illustrating the direction of the fluid flow patterns;

FIG. 2 is a top view of the tank and heat exchanger shown in FIG. 1;

FIG. 3 is a broken-away perspective of one corner of the heat exchanger illustrating its structure, and also a clamp used for securing the modular unit on a cylindrical surface;

FIG. 4 is a sectional end view of the tank showing the modular heat exchanger attached and illustrating the connection of the clamps employed;

FIG. 5 is a broken-away perspective of the thermal exchange element with the manifold removed and enlarged to show its structural details;

FIG. 6 illustrates in elevation the U-shaped connectors for connecting multiple modular panels in series;

FIG. 7 is an elevation of the end plug used to close off the ends of the flow tubes in the manifold when desired;

FIG. 8 illustrates an elevation of two modular units stacked vertically (with parts broken away), along with a coupling to interconnect them for tanks of heights over four feet; and FIG. 9 is a perspective of an end portion of a manifold unit illustrating its construction details.

DESCRIPTION OF A PREFERRED EMBODIMENT

Referring to FIGS. 1 and 2, the general construction of the novel plastic heat exchanger 10 can be seen. It is shown installed on a cylindrical tank A, such as a wine vat. As can be seen in FIG. 2, three separate modular units are connected in series whereby an inlet pipe 11 provides a pressurized feed of heated or cooled liquid from a source (not shown) which flows circumferentially around the tank (illustrated by arrows B) to a return outlet pipe 12 which is connected to return the feed to the source. The pumping system is conventional, and therefore is not described or illustrated.

More specifically, the construction of the thermal exchange element 13 is best illustrated in FIGS. 3 and 5. Basically, it is composed of an outer sheet 14 and an inner sheet 15 which are separated by ribbons or ribs 16. Normally the sheets are plastic, and preferably a polyolefin, such as polyethylene or polypropylene. Also, the ribs 16 are of similar material. As can be seen, the ribs have their edges fused to inside surfaces of the sheets where they are arranged in a spaced-apart relationship forming a series of parallel channels having a rectangular cross-section. With appropriate dies, the sheets and ribbons can be extruded as a composite unit to form this element.

On the exterior surface of the outer sheet 14 a foam layer 17 having a thickness from $\frac{1}{8}$ inch to $\frac{3}{4}$ inch is secured by sealing it to this surface. This foam layer is co-extensive with the exterior surface of this sheet, and is usually attached with an adhesive which joins the foam and the surface so no air space exists therebetween. Normally a closed cellular foam is employed which is not air permeable. Due to the tight continuous seal of the foam layer with sheet 14 and the non-permeable character of the foam layer, no rime ice forms on the exterior surface of the outer sheet.

While the foam layer 17 is co-extensive with the exterior surface of sheet 14 of the thermal exchange element 13, portions of the opposite edges 18 thereof where the channels are accessible are not covered with the foam layer where they are inserted into the manifold unit 20. This manifold unit includes a hollow tubular structure 21 having a central flow tube 22 and a tangentially extending distributor element 23 which is usually fused to the tubular structure, or alternatively made integral therewith in a single extrusion. By making the distributor project tangentially from the manifold, as can be seen in FIGS. 3 and 9, the inner sheet 15 of the thermal heat exchange element can be maintained flat against a cylindrical surface in the area of its connection to the manifold unit.

An edge 18 of the thermal exchange 13 is inserted between the separated lips 24 of the distributor element 23 until it contacts shoulder 25 (see FIG. 9). Prior to the insertion of the edge 18, a plurality of holes 27 are drilled parallel to and between the lips to intersect the central flow tube 22 of the manifold. As a result of these holes and the large lengthwise duct 26 adjacent shoulders 25, fluids from the flow tube can simultaneously communicate with all the channels in thermal exchange means 13. After the edge 18 is sealed with the inner surfaces of the lips, the opposite ends of duct 26 are plugged thereafter to eliminate leakage.

The completed modular unit 10 is then ready to be installed on and retained on a tank or the like. As can be seen in FIGS. 1, 2, 3 and 4, this can be conveniently done with clamping devices. Specifically, C-shaped clamps can be used to grip one of the manifold units 20 and a similar clamp can be used on an adjacent manifold unit (see FIG. 4). A bolt 32 of an appropriate length is used to connect the flanges 31 and then tightened to cinch the modular unit against the tank A. Multiple clamps are used which are spaced axially along the manifold units as necessary. Multiple modular units are used, depending on the circumference of the tank. On a tank ten feet in diameter, three ten-foot modules would be used. The bolts are tightened to ensure that the inner surface of sheet 15 of each thermal exchange element 13 is faced tightly against the tank surface. If desired, a thermal conducting grease can be disposed between this surface and the tank surface. Such greases are well-known in the heat exchange art.

Once the modular units are assembled on the tank, they are connected for series flow. This is accomplished with U-shaped adjustable fittings 40. These fittings have two elbows 41 with an interconnecting pipe 42 which is cut to the appropriate length C to fit the assembled modules. The fittings also have a nipple 43 inserted into each elbow with an O-ring 44 disposed in a groove near the distal end of the nipple. Once a fitting has been adjusted to fit the modular unit (pipe 42 cut to length), the joints are solvent-welded and the nipples are inserted into the flow tubes 22 of the modular units and pushed in so the O-rings extend past a screw 45 near the opposite ends of the manifold units 20. Thereafter, this screw is turned in to lock the fitting in the manifold unit.

For best flow characteristics, these fittings 40 are used at both the top and bottom ends of the manifold units that are connected in series. End plug 46 which includes a cap 47 and a nipple 48 also uses an O-ring similarly located to the ones on the fitting 40 so it can be used to close off the ends of manifold units when desired (see FIG. 8). It is locked in place by screw 45 in the same manner as fitting 40. In all cases, the locking screw 45 is outside the O-ring seal to eliminate leakage. Obviously, the fittings can be easily removed from the manifold unit for maintenance, repair or removal by removing screws 45.

In FIG. 8, a connecting nipple 50 is illustrated. It is constructed like the U-shaped fittings 40, but connects side-by-side modular units where tanks of heights greater than five feet are involved.

Normally, the modular units are sized with ten foot lengths and the thermal exchange elements 13 are normally forty-eight inches wide to offer maximum flexibility in fitting tanks with various fittings connected thereto. Also, the exterior piping is connected with a nipple of a construction similar to those of fittings 40 and the end plug 46.

I claim as my invention without limitation as follows:

1. A heat exchange tank system comprising:

a cylindrical tank having a smooth exterior surface;

at least one modular plastic heat exchanger circumferentially disposed around the outer circumference of said tank, said modular plastic heat exchanger including at least one thermal exchange means composed of parallel inner and outer plastic sheet means separated by a plurality of parallel flat ribs oriented normal to said sheet means and fused to said sheet means to form a plurality of parallel channels; a first manifold means having a central large flow tube and a distributor means operably connected to said thermal exchange means at one edge so said flow tube is normal to the longitudinal axes of said channels and to fluidly communicate said channels with said flow tube; and a second manifold means having a large central flow tube and a distributor means operably connected to the edge of said thermal exchange means opposite said first manifold means so said flow tube is normal to the axes of said channels and to fluidly communicate said channels with its flow tube, whereby fluids can enter one flow tube and simultaneously pass through said channels of said thermal exchange means to the other flow tube;

clamping means operably connected between said first and second manifold means to tension said thermal exchange means so its inner sheet means is forced tightly against said smooth surface of said tank; and fitting means connected to said flow tube means to operably communicate them with fluid ingress and egress lines for heating or cooling said tank by pumping the appropriate fluids therethrough.

2. The heat exchange tank system defined in claim 1 wherein the modular plastic heat exchanger includes an insulating foam layer co-extensive with the outer sheet means and sealingly adhered to its exterior surface.

3. A modular plastic heat exchanger comprising:

at least one thermal exchange means composed of parallel inner and outer plastic sheet means separated by a plurality of parallel flat ribs oriented normal to said sheet means and fused to said sheet means to form a plurality of parallel channels;

an insulating foam layer co-extensive with the outer sheet means and sealingly adhered to one of its exterior surfaces;

a first manifold means having a central large cylindrical flow tube and a distributor means operably connected to said thermal exchange means at one edge so said flow tube is normal to and disposed tangentially to the longitudinal axes of said channels and arranged to fluidly communicate said channels with said flow tube; and a second manifold means having a large central cylindrical flow tube and a distributor means operably connected to an edge of said thermal exchange means opposite said first manifold means so said flow tube is normal to and disposed tangentially to the longitudinal axes of said channels and arranged to fluidly communicate said channels with its flow tube and clamping means operable to engage said first and second manifold means to secure said thermal exchange means against a surface to be thermally controlled, whereby fluids can enter one flow tube and simultaneously pass through said channels of said thermal exchange means to the other flow tube.

4. The modular heat exchanger defined in claim 3 which includes fitting means employing O-rings received in the ends of the central flow tube of each manifold means and screw retaining means to lock said fitting means therein for communicating fluids to and from said manifold means.

* * * * *